United States Patent [19]

Sundermeier

[11] 4,449,269

[45] May 22, 1984

[54] SPRING BIASED FURNITURE HINGE HAVING A BRAKE MECHANISM

[75] Inventor: Günter Sundermeier; Ulrich Beneke, both of Bünde, Fed. Rep. of Germany

[73] Assignee: Paul Hettich & Co., Kirchlengern, Fed. Rep. of Germany

[21] Appl. No.: 380,012

[22] Filed: May 19, 1982

[30] Foreign Application Priority Data

May 21, 1981 [DE] Fed. Rep. of Germany ..... 3120201

[51] Int. Cl.³ ..... E05F 3/20

[52] U.S. Cl. ..... 16/50; 16/302; 16/333; 16/341; 16/352; 16/360; 16/363

[58] Field of Search ..... 16/50, 56, 57, 58, 288, 16/292, 302, 303, 307, 308, 327, 333, 341, 342, 345, 347, 348, 352, 360, 363, 370, 371, 374, DIG. 20

[56] References Cited

U.S. PATENT DOCUMENTS 4,075,735 2/1978 Rock et al. ..... 16/50 X
4,310,948 1/1982 Rock et al. ..... 16/370 X

FOREIGN PATENT DOCUMENTS 3018184 11/1981 Fed. Rep. of Germany ..... 16/302

*Primary Examiner*—Fred Silverberg
*Attorney, Agent, or Firm*—Michael J. Striker

[57] ABSTRACT

A furniture hinge for two housing parts has a housing mounted on one furniture part, a hinge arm mounted on the other furniture part, two pivotable hinge plates pivotally connecting the housing with the hinge arm, a spring which forms a locking device, a cylinder-and-piston unit having a piston pivotally mounted on the hinge arm and a brake cylinder slidably movable relative to the piston under the action of a cam lever mounted on one of the hinge plates and arranged to move the brake cylinder relative to the piston, wherein the sliding surface of the brake cylinder and/or the piston has a friction-increasing coating.

11 Claims, 2 Drawing Figures

SPRING BIASED FURNITURE HINGE HAVING A BRAKE MECHANISM

BACKGROUND OF THE INVENTION

The invention relates to a furniture hinge with a cup shaped housing which can be inserted into a recess of a furniture part, a hinge arm which is mountable on another furniture part with two hinge plates provided between the housing and the hinge arm pivotably mounted on hinge pins and a locking device provided with a spring.

A furniture hinge of this type is known (DE-OS No. 26 11 942), wherein the spring of the locking device is shaped as a shank spring. By this shank spring, an additional locking force is exerted on the door during the last portion of the locking movement, so that the locking movement is intensified and the door strikes correspondingly hard.

SUMMARY OF THE INVENTION

This object is solved in accordance with the invention in that in or on the hinge arm a pivotable piston is pivotably mounted around a traverse axis, a brake cylinder is slideably mounted on the piston, the brake cylinder is moveable relative to the piston by a cam lever which is mounted on the hinge plate adjacent to the mounting side for the hinge arm, and that the slide faces of the piston and/or the brake cylinder are provided with a coating increasing the friction values.

In an advantageous embodiment of the invention the free end of the cam lever engages into a groove of the brake cylinder assuring an idle stroke over the first angle range of the opening movement.

In accordance with the invention, it is assured that the brake cylinder becomes effective substantially during the last portion of the locking movement of the hinge or the door, and that the locking movement is not intensified by the spring of the locking device but dampened in this angle area. The brake forces which are generated during the sliding movement of the cylinder on the piston or the parallel disposed rod pistons can be influenced by the selection of the coating for the slide faces by which the friction values are increased and by shaping the sliding faces. The piston or the rod pistons may have a cross section, such that the sum of all slide faces is large. The cross section of the piston or the rod piston may be multi cornered, star shaped, or the like.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 2:
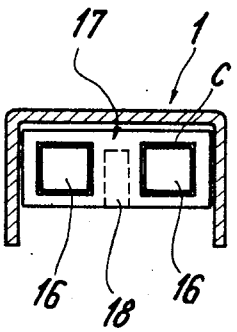
FIG. 2 a section along line II—II in FIG. 1
Figure 1:
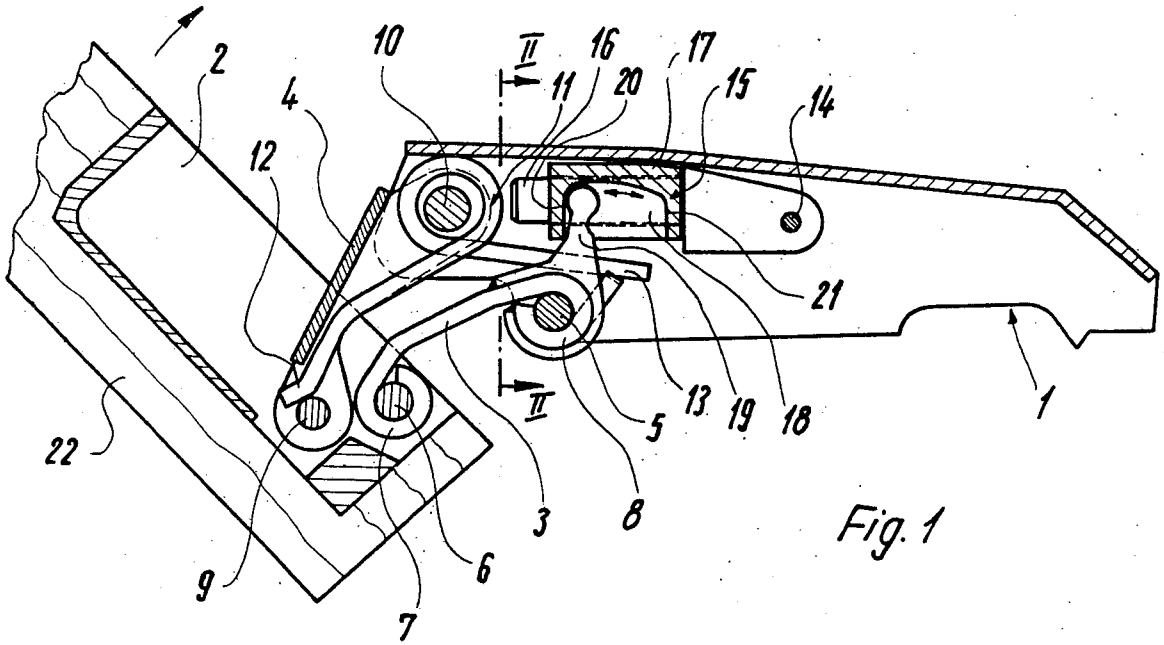
FIG. 1 the furniture hinge in its intermediary position.

The furniture hinge illustrated in FIGS. 1 and 2 is provided with a hinge arm 1 which can be mounted on a furniture part and a cup shaped housing 2 which is inserted into a recess of a door and connected by means of a hinge plate 3 and a hinge plate 4 with hinge arm 1. The hinge plate 3 is pivotably mounted on a hinge pin 5 mounted on the hinge arm and a hinge pin 6 mounted in the housing and engages these hinge pins with their rolled end pieces 7 and 8. The hinge plate 4 is pivotably mounted on a hinge pin 9 mounted on the housing and a hinge pin 10 mounted in the hinge arm. From FIG. 1, it can be seen that the hinge pin 10 of hinge arm 1 extends into housing 2 in the locking position of the furniture hinge. The hinge pin 10 is encompassed by a shank spring 11 which supports with its one shank end 12 on the lower hinge pin 9 of housing 2 and with their other shank end 13 in the area of hinge pin 5.

A piston 15 is pivotably mounted around a transverse axis 14 in hinge arm 1. A brake cylinder 17 is slideably mounted on the piston, which in the illustrated embodiment consists of two parallel extending rod piston 16 with a rectangular cross section, whereby the outer shape of the brake cylinder corresponds to the inner shape of the hinge arm 1. The slide faces of piston 15 and/or the brake cylinder 17 are provided with a coating C as shown in FIG. 2, which increases the friction values. This coating may consist of a plastic mass or a rubber mass. Stationary components may be imbedded into these materials.

The brake cylinder 17 is provided with a groove 18 which is engaged by the free end of a cam lever 19. The front faces 20 and 21 of groove 18 form the abutment faces for the cam lever 19.

When the locking movement of the hinge is continued from the intermediary position of FIG. 1, wherein the cam lever 19 engages the abutment face 20, the cam lever 19 moves to the left and moves the brake cylinder 17 in the same direction. Thereby, the locking movement is subjected to a brake force, so that a light closing of the door 22 occurs. When opening the door, the cam lever 19 moves on a circular curve around the hinge pin 5 to the right, so that an idle stroke occurs at first before the cam lever comes into engagement on face 21, thus moving the brake cylinder into the other end position which it assumes during completely opened hinge.

As can be seen from FIG. 2, the groove 18 for receiving the free end of the cam lever 19 is disposed in the center plane of the brake cylinder 17.

In the exemplified embodiment in accordance with FIG. 1, the cam lever 19 is a part of a sheet metal member 23 which is mounted on end roller 8.

It will be understood that each of the elements described above, or two or more together, may also find a useful application in other types of constructions differing from the types described above.

While the invention has been illustrated and described as embodied in a furniture hinge, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications which, from the standpoint of prior art, fairly constitute essential characteristics of the generic or specific aspects of this invention.

What is claimed as new and desired to be protected by Letters Patent is set forth in the appended claims:

1. A furniture hinge for two housing parts movable relative to one another, comprising a housing mounted on one furniture part;

a hinge arm mounted on the other furniture part;

two pivotable hinge plates pivotally connecting said housing with said hinge arm;

locking means provided with a spring mounted on one of the hinge plates;

a cylinder-and-piston unit having a piston pivotally mounted on said hinge arm and having a first sliding surface, and a brake cylinder slidably movable relative to said piston and having a second sliding surface;

a cam lever mounted on another of said hinge plates and arranged to move said brake cylinder relative to said piston; and means for increasing friction between said brake cylinder and said piston and including a friction-increasing coating provided on at least one of said first and second sliding surfaces.

2. A furniture hinge as defined in claim 1, wherein said means for increasing friction also includes another friction increasing coating provided also at the other of said surfaces.

3. A furniture hinge as defined in claim 1, wherein the one furniture part has a recess, said housing being cup-shaped and arranged in the recess of the one furniture part.

4. A furniture hinge as defined in claim 1, wherein said hinge arm has a recess, said piston being arranged in said recess of said hinge arm.

5. A furniture hinge as defined in claim 1, wherein said housing and said hinge arm are pivotable relative to one another in a first direction, said piston being mounted on said hinge arm pivotally about an axis which is transverse to said first direction.

6. A furniture hinge as defined in claim 1; and further comprising pivot axles connected with said housing and said hinge arm and pivotally supporting said hinge plates.

7. A furniture hinge as defined in claim 6, wherein said cam lever is formed as a part of a sheet metal member mounted on the axle of said one hinge plate.

8. A furniture hinge as defined in claim 1, wherein said hinge arm is connected with the other furniture part in a predetermined point, said hinge plates including a hinge plate which is located closer to said point and forms said one hinge plate on which said cam lever is mounted.

9. A furniture hinge as defined in claim 1, wherein said housing and said hinge arm, and said cam lever are movable in direction of opening and closing movements, said cam lever having a free end, and said cylinder having a groove arranged so that said free end of said cam lever engages in said groove and said groove assures an idle stroke in a first angular region of the opening movement and in a first angular region of a closing movement.

10. A furniture hinge as defined in claim 1, wherein said hinge arm has a recess and a predetermined inner contour, said cylinder having an outer contour which corresponds to the inner contour of said hinge arm, said piston being formed by a plurality of parallel rod-like pistons.

11. A furniture hinge as defined in claim 1, wherein said brake cylinder has a center plane, said groove being located in said center plane of said brake cylinder.

* * * * *